US011654703B2

(12) United States Patent
Chiang et al.

(10) Patent No.: US 11,654,703 B2
(45) Date of Patent: May 23, 2023

(54) MOVABLE PAPER GUIDE STRUCTURE OF A LABEL PRINTER

(71) Applicant: TSC Auto ID Technology Co., Ltd., New Taipei (TW)

(72) Inventors: Hawk Chiang, New Taipei (TW); Ko-Chun Chen, New Taipei (TW); Shang-Shih Kuo, New Taipei (TW)

(73) Assignee: TSC AUTO ID TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/411,478

(22) Filed: Aug. 25, 2021

(65) Prior Publication Data

US 2023/0062948 A1 Mar. 2, 2023

(51) Int. Cl.
*B41J 15/04* (2006.01)
*B41J 3/407* (2006.01)

(52) U.S. Cl.
CPC ..... *B41J 15/046* (2013.01); *B41J 3/4075* (2013.01)

(58) Field of Classification Search
CPC ..... B41J 3/4075; B41J 15/046; B65H 16/02; B65H 23/038; B65H 2301/413; B65H 2511/12; B65H 2801/12
See application file for complete search history.

(56) References Cited

U.S. PATENT DOCUMENTS 4,206,704 A * 6/1980 Sato ..... B65C 11/021 101/291
2004/0140387 A1* 7/2004 Ishida ..... B65H 23/10 242/417.3
2006/0269348 A1* 11/2006 Nagata ..... B41J 11/0095 400/615.2
2008/0173750 A1* 7/2008 Takeuchi ..... B41J 15/042 242/564.1
2011/0063391 A1* 3/2011 Miyamoto ..... B65H 23/16 242/566
2016/0039229 A1* 2/2016 Zhang ..... B65H 23/048 242/615.3
2017/0106681 A1* 4/2017 Blom ..... B65H 29/52

* cited by examiner

*Primary Examiner* — David H Banh
(74) *Attorney, Agent, or Firm* — Chun-Ming Shih; HDLS IPR Services

(57) ABSTRACT

A movable paper guide structure of a label printer includes: a paper guide body installed in the label printer including a roller and a print head; a movable unit that is movably installed on the paper guide body close to one end of the print head, adapts to a displacement of the roller and the print head because of a changed contact position, and keeps approaching the print head during a print process of the label printer for neither gap between the tip of the movable unit and the print head nor other problems such as a label sticker on printing paper improperly peeled off, printing crooked and paper jam.

3 Claims, 2 Drawing Sheets

MOVABLE PAPER GUIDE STRUCTURE OF A LABEL PRINTER

BACKGROUND OF THE INVENTION

1. Field of the Invention

The present application is classified as the field for the structure of a label printer and particularly related to a design based on a movable paper guide structure on a label printer with which some risks such as a label sticker improperly peeled off, printing crooked and paper jam are avoided for smooth and reliable printing in case of a piece of printing paper pulled back.

2. Description of the Prior Art

As machinery equipment specially used in label printing, the label printer is good in specific applications and applicable to label paper different from ordinary one according to distinct properties like dimension, thickness or material of a piece of selected label paper for printing based on the thermo-induction principle with which a necessary pattern is generated on a piece of label paper contacted by a thermal printing head (TPH) as required.

As shown in FIG. 3, the printing process of a conventional label printer, which features a label paper roll 400' including continuous paper and installed on a label printer as usual, illustrates one end of the label paper roll 400' is guided to a printing area by a paper guide structure 100' and a label sticker 410' on the label paper roll 400' pressed by a roller 500' contacts with a print head 600' for completion of printing of the label sticker 410'.

For sufficient pressure applied on the label sticker 410' to be printed, the label sticker 410' should be properly clamped by both the roller 500' and the print head 600' which is equipped with a spring at the back in general. However, the paper guide structure 100' in the prior art is a fixed device which is criticized for the drawback of a displacement of the roller 500' and the print head 600' due to a distinct thickness of the label sticker 410'. Specifically, the paper guide structure 100' has a tip 110' at a fixed position. When a displacement of the roller 500' and the print head 600' due to the label sticker 410' with a distinct thickness takes place, a gap d' is generated between the fixed tip 110' of the paper guide structure 100' and the print head 600'. Moreover, when a segment of paper, which fails to be printed at first and needs to be reprinted correctly because of the gap d', is pulled back or the label sticker 410' designed as an RFID label sticker is pulled back for a rewrite step, the label sticker 410' on the label paper roll 400' is improperly peeled off by the tip 110' of the paper guide structure 100' or another failure such as printing crooked or paper jam occurs.

Accordingly, how to avoid the gap d' between the paper guide structure 100' and the print head 600' for neither the label sticker 410' improperly peeled off nor further problems such as printing crooked and paper jam is an issue deserving to be overcome by persons skilled in the art aggressively. In particular, label printer structure, printing quality and cost of a consumable, each of which is an issue worthy of attention, should be considered attentively.

SUMMARY OF THE INVENTION

The present application is to provide a movable paper guide structure of a label printer, which is based on a changed contact position of a print head and a roller to rotate automatically for no gap in between such that some problems such as label sticker improperly peeled off, printing crooked and paper jam are avoided.

The present application is further to provide a movable paper guide structure of a label printer, which is driven by a spring, a belt or a motor and applicable to a selected model for flexible installation as required.

The present application is further to provide a movable paper guide structure of a label printer, which features a simple structure for easy installation and eliminates printing-related issues without a significantly increasing cost.

To achieve the above and other goals, a movable paper guide structure of a label printer in a technical solution of the present application comprises a paper guide body and a movable unit.

The paper guide body, which is installed in a label printer including a roller and a print head, is used to guide a piece of printing paper for a forward movement along a designated printing route; the movable unit, which is movably installed on the paper guide body close to one end of the print head, adapts to a displacement of the roller and the print head because of a changed contact position and keeps approaching the print head for no gap between the tip of the movable unit and the print head.

Accordingly, the movable unit in the present disclosure is adjustable forthwith and close to the print head during a printing process such that the front end of the movable unit is not hit by a piece of printing paper which is being pulled back for no incidents such as a label sticker improperly peeled off, printing crooked and paper jam.

In the above mechanism, the movable unit is pivotally fitted to the paper guide body by a pivot and movably installed on the paper guide body close to one end of the print head.

The movable unit is mounted on the paper guide body with a spring, a belt or a motor and movably installed on the paper guide body close to one end of the print head.

The movable unit is characteristic of a sharp portion which gradually tapers toward one end of the print head and keeps abutting the print head in case of a displacement of the movable unit.

DETAILED DESCRIPTION OF THE PREFERRED EMBODIMENT

Figures 1, 1A:
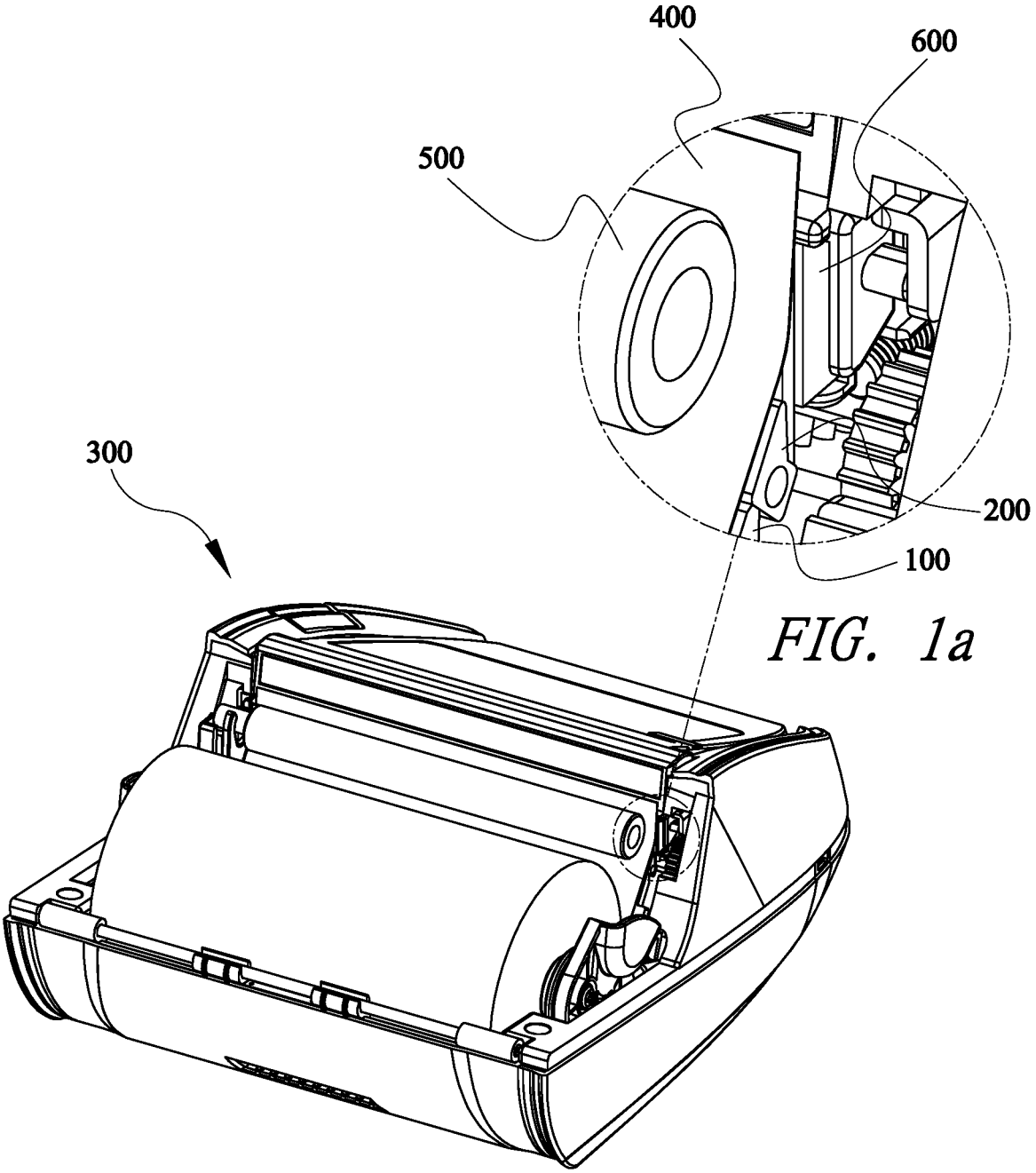
FIG. 1 is a schematic perspective view for an installed position of a movable paper guide structure of a label printer.
FIG. 1*a* is a partial enlargement view for the movable paper guide structure of the label printer in FIG. 1.
Figure 2:
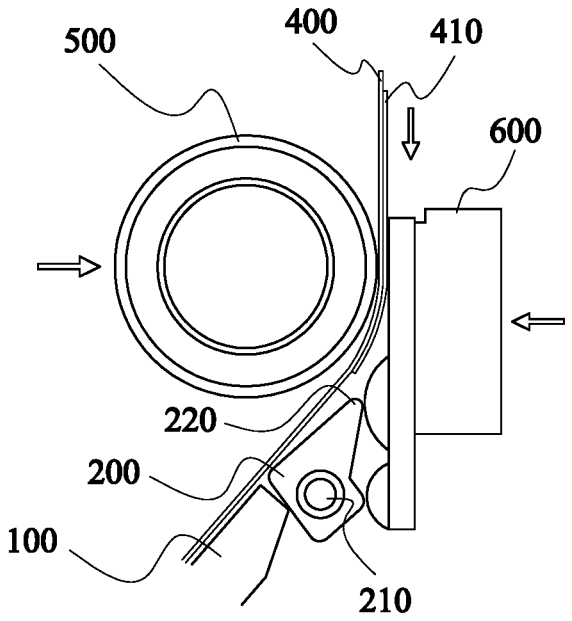
FIG. 2 is a schematic plane view for a movable paper guide structure of a label printer during a printing process.
Figure 3:
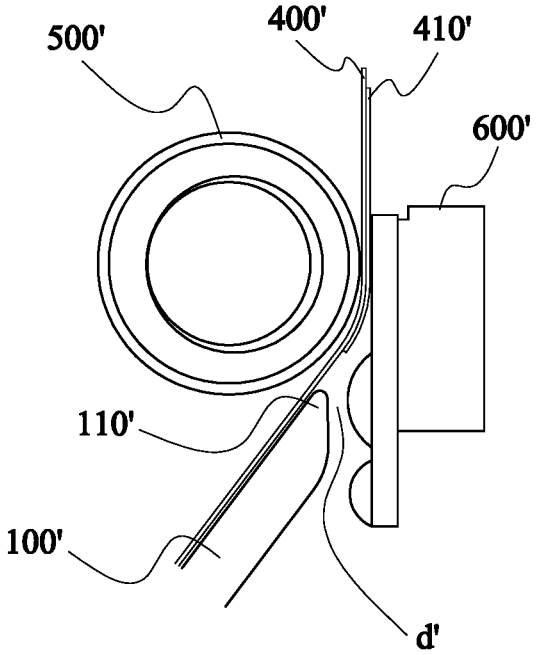
PRIOR ART FIG. 3
FIG. 3 is a schematic plane view for a fixed paper guide structure of a conventional label printer during a printing process.

Referring to FIGS. 1, 1*a* and 2 for a movable paper guide structure of a label printer, which comprises a paper guide body 100 and a movable unit 200.

The paper guide body 100 installed in a label printer 300 is used to guide a piece of printing paper 400 for a forward movement along a designated printing route wherein the piece of printing paper 400 fed into a printing area is pressed by a roller 500 mounted inside the label printer 300 and contacts with a print head 600 by which a pattern is printed on the piece of printing paper 400 and/or a label sticker 410 as required.

In an embodiment, the movable unit 200 is pivotally fitted to the front end of the paper guide body 100 by a pivot 210 and movably installed on the paper guide body 100 close to one end of the print head 600 such that the print head 600 is approached by the movable unit 200 during a rotary motion without generation of a gap.

According to the above structural composition, a movable paper guide structure of a label printer in the present disclosure is characterized in that the movable unit 200 rotates about the pivot 210 as a center of rotation such that the print head 600 is approached by the front end of the movable unit 200 without generation of a gap. In principle, the printing paper 400 in the present disclosure denotes a label paper roll on which a distinct type of label sticker 410 with a certain thickness is coated. When the label sticker 410 on the printing paper 400 is pressed by the roller 500 and contacts with the print head 600, a displacement of the roller 500 and the print head 600 due to the label sticker 410 with a distinct thickness occurs. If this issue is not corrected properly, the printing paper 400 pulled back during a printing process probably collides with the front end of the movable unit 200 and is peeled off or other incidents such as printing crooked and paper jam take place. Accordingly, the movable unit 200 in the present disclosure shifts automatically by referring to a changed contact position of the roller 500 and the print head 600 such that the front end of the movable unit 200 is always close to the print head 600 effectively for neither the label sticker 410 improperly peeled off nor other problems such as printing crooked and paper jam.

Moreover, the movable unit 200 is characteristic of a sharp portion 220 forward tapering from the pivot 210 in shape such that the sharp portion 220 with good flexibility features an adjustable position based on a displacement of the roller 500 and the print head 600 and always abuts the print head.

In addition, the movable unit 200, which is mounted on the paper guide body 100 with a spring, rotates automatically in case of a displacement of the roller 500 and the print head 600; alternatively, the movable unit 200 is driven by a belt, a motor or another equivalent mechanism for the same effect. In the present disclosure, a movable paper guide structure of a label printer is described with a label sticker 410 used in an embodiment and even applicable to an alternative printing mode without a label sticker 410, for example, thermal transfer receipt printing, in which the movable unit 200 always abuts the print head 600 in structural design for fewest drawbacks like printing crooked.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A movable paper guide structure of a label printer, comprising:

a paper guide body, which is installed in the label printer including a roller and a print head and used to guide a piece of paper to be printed for a forward movement along a designated printing route during a printing process of the print head; and a movable unit, which is movably installed on the paper guide body close to one end of the print head and adapts to a displacement of the roller and the print head because of a changed contact position, the movable unit comprises a sharp portion which gradually tapers toward one end of the print head and keeps abutting the print head in case of the displacement of the movable unit.

2. The movable paper guide structure of the label printer as claimed in claim 1, wherein the movable unit is pivotally fitted to the paper guide body by a pivot and movably installed on the paper guide body close to one end of the print head.

3. The movable paper guide structure of the label printer as claimed in claim 1, wherein the movable unit is mounted on the paper guide body with a spring, a belt or a motor and movably installed on the paper guide body close to one end of the print head.

* * * * *